United States Patent [19]

Digby

[11] Patent Number: 4,984,323

[45] Date of Patent: Jan. 15, 1991

[54] DENTURE BRUSH DEVICE

[76] Inventor: Kevin C. Digby, 6863 Sherbrooke Street, Vancouver, British Columbia, Canada, V5X 4C9

[21] Appl. No.: 452,758

[22] Filed: Dec. 29, 1989

[30] Foreign Application Priority Data

Jan. 18, 1989 [CA] Canada ..... 588555

[51] Int. Cl.[5] ..... A46B 13/00

[52] U.S. Cl. ..... 15/104.920; 15/21.1; 15/28

[58] Field of Search ..... 15/104.92, 21 R, 21 A, 15/28; 248/363

[56] References Cited

U.S. PATENT DOCUMENTS

| | | | |
|---|---|---|---|
| 1,683,458 | 9/1928 | Hall | 15/21 A |
| 1,845,315 | 2/1932 | Meikle | 15/104.92 |
| 2,236,462 | 3/1941 | Binkley | 15/21 A |
| 3,149,358 | 9/1964 | Chadbourne | 15/21 R |
| 3,675,886 | 7/1972 | Kampmier | 248/363 |
| 3,765,638 | 10/1973 | Harrison | 248/363 |
| 3,774,256 | 11/1973 | Gauthier | 15/21 R |
| 4,171,167 | 10/1979 | Swartwout | 15/21 A |

FOREIGN PATENT DOCUMENTS

| | | | |
|---|---|---|---|
| 884955 | 11/1971 | Canada | 15/109 |

*Primary Examiner*—Henry J. Recla
*Assistant Examiner*—Glenn T. Barrett
*Attorney, Agent, or Firm*—Fulwider Patton Lee & Utecht

[57] ABSTRACT

A denture brushing device comprising a container having an open top, a base and an essentially cylindrical cross-section with a denture receiving portion of reduced cross-sectional area adjacent the base of the container. A support member to support dentures to be cleaned is located in the denture receiving portion. A container lid adapted for threaded engagement with the container is provided, the lid having a manually rotatable brush extending therethrough such that when the lid is fitted on the container the brush extends into the container to contact dentures in the denture receiving portion. Rotation of the brush acts to clean the dentures, the denture receiving portion preventing the dentures from rotating with the brush.

6 Claims, 1 Drawing Sheet

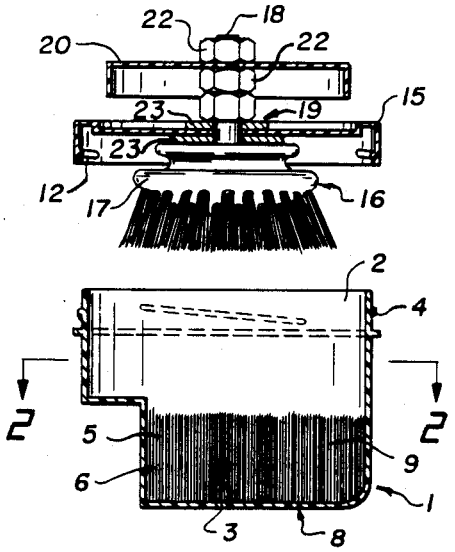
Fig. 1.
Fig. 2.
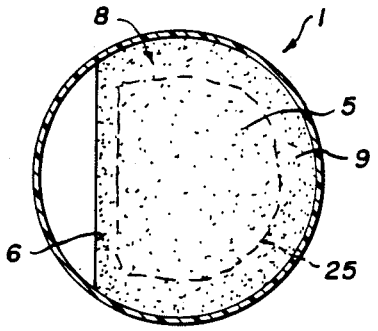
Fig. 3.
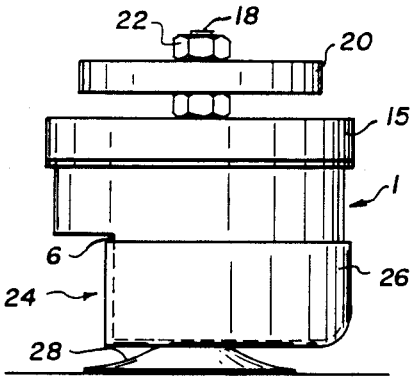
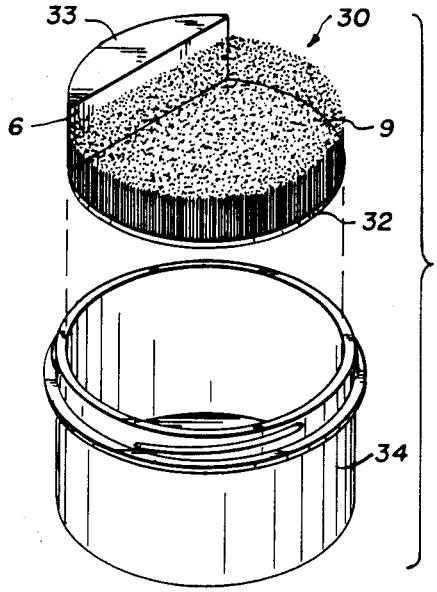
Fig. 4.

DENTURE BRUSH DEVICE

FIELD OF THE INVENTION

This invention relates to an apparatus for brushing and cleaning dentures.

DESCRIPTION OF THE PRIOR ART

Dentures, or false teeth as they are also known, can be difficult to clean. Scrubbing dentures with a conventional tooth brush or using commercially available effervescent tablets to clean dentures are both popular techniques. Scrubbing dentures with a tooth brush can be a messy and annoying operation particularly for the elderly and stroke or arthritis victims who only have limited use of their hands or possibly only use of a single hand. Therefore, there exists a need for a denture brushing device that effectively and efficiently cleans dentures with a minimum of effort and mess, and is also suitable for persons having limited use of their hands.

Prior art devices for brushing dentures are known. Canadian Patent No. 884,955 to Tomer discloses a denture brushing device that uses a pair of mating rotatable containers each equipped with a brush attached to move with its respective container, the containers being joined together to create a housing in which dentures to be cleaned are positioned between the brushes. The device requires two hands to operate in a rather awkward motion with the fingers of each hand grasping and rotating mating containers in opposite directions and the palms of the hands acting to force the brushes inwardly against the dentures to be cleaned. In this manner the brushes are rotated over the dentures. The device has a tendency to leak and unless equal inward pressure is applied to both brushes, the dentures tend to rotate with one of the brushes greatly reducing the cleaning and scraping effect of that brush.

SUMMARY OF THE INVENTION

The present invention provides an improved denture cleaning device that avoids the problems of the prior art, cleans dentures quickly and efficiently and is simple and convenient to use particularly for persons who have limited use of their hands. Accordingly, the present invention is denture brushing device comprising:

a container having an open top, a base and an essentially cylindrical cross-section with a denture receiving portion of reduced cross-sectional area adjacent the base of the container;

support means in said denture receiving portion to support dentures placed in said device;

a container lid adapted for threaded engagement with said container, said lid having a manually rotatable brush extending therethrough such that when said lid is fitted on said container said brush extends into said container whereupon rotation of said brush acts to clean said dentures, said denture receiving portion preventing said dentures from rotating with said brush.

BRIEF DESCRIPTION OF THE DRAWING

An embodiment of the present invention is shown in the accompanying drawings in which:

FIG. 1 is a sectioned view through the denture brushing apparatus;

FIG. 2 is a plan view of the apparatus taken along line 2—2 of FIG. 1; and

FIG. 3 shows the present invention being used with a locating suction cup attachment.

FIG. 4 shows an alternative embodiment of the present invention using an insert member to form the denture holding cavity.

DESCRIPTION OF THE PREFERRED EMBODIMENTS

FIG. 1 shows a first embodiment of the present invention comprising a container 1 having an open top 2 and a closed base 3. As shown in FIG. 2, the container has an essentially cylindrical cross-section and is made from plastic.

Adjacent base 3, the container is formed into a denture receiving portion 5 by forming an offset bracing wall 6 that extends across container 1. As shown in FIG. 2, bracing wall 6 forms denture receiving portion 5 into an essentially U-shaped cavity. The bracing wall may be molded integrally with the container as shown in FIG. 1 or the wall may formed as a separate element that is inserted into container 1.

Within denture receiving portion 5, there is a support member 8 comprising a plurality of stiff bristles 9 extending upwardly from base 3. Bristles 9 act to cushionably support dentures that are placed into receiving portion 5.

It is also within the scope of this invention to form denture receiving portion 5 using a replaceable insert member 30 as shown in FIG. 4. Insert member 30 has a base 32 with bristles 9 mounted thereto and a step 33 rising upwardly from an edge of the base to define bracing wall 6. Such an insert is moulded from plastic and shaped for insertion into a cylindrical container 34 for attachment to the container's base to convert the bottom of the container into the denture receiving portion necessary in the present invention. Such an arrangement would make a specially moulded container 1, as shown in FIG. 1, unnecessary.

Open top 2 of container 1 is formed with threads 4 adapted to engage corresponding threads 12 on the inner surface of container lid 15. When lid 15 is tightened onto container 1, the container is sealed. Lid 15 is formed from the same plastic material as container 1.

There is a manually rotatable brush 16 centrally positioned in lid 15. The brush comprises a head 17 with a plurality of flexible bristles extending downwardly therefrom. The top of brush head 17 is attached to threaded shaft 18 that extends through bearing 19 and the lid. In its simplest form bearing 19 can comprise locating nuts 22 with a pair of washers 23 positioned on either side of the lid. A gripping handle 20 is also attached to shaft 18.

FIG. 3 shows the present invention being used with a suction cup attachment 24 that allows the device to be releasably mounted to a smooth flat surface such as a bathroom counter. Attachment 24 comprises a receptacle portion 26 mounted on a suction cup 28. Receptacle portion 26 is adapted to receive the lower portion of container 1 and hold it to prevent the container from rotating when handle 20 is rotated. This arrangement makes it possible to operate the device of the present invention using only a single hand to rotate handle 20.

The device of the present invention is used in the following manner:

Dentures to be cleaned are placed in denture receiving portion 5 atop support member 8. A cleaning compound and water are added to the container. Lid 15 is then tightened into place and gripping handle 20 is rotated to move the cleaning bristles over the dentures. Bracing wall 6 in the denture receiving portion 5 acts to prevent rotation of the dentures within its cavity. As shown by dashed lines in FIG. 2, dentures 25 are too large to rotate within the reduced area of the denture receiving portion. Dentures 25 will rotate slightly with brush 16 until the dentures contact bracing wall 6 which prevents further rotation. Brush 16 has flexible bristles that bend and move out of the way as they contact the bracing wall thereby allowing the brush to be fully rotated.

When using the present invention with suction cup attachment 24 as shown in FIG. 3, container 1 can be quickly and easily removed from receiving portion 26 after cleaning to allow the water and the cleaning agent to be poured down a sink drain.

Although the present invention has been described in some detail by way of example for purposes of clarity and understanding, it will be apparent that certain changes and modifications may be practiced within the scope of the appended claims.

I claim:

1. A denture brushing device comprising:

a container having an open top, a base, upper portion with an essentially cylindrical cross-section, and a denture receiving portion of reduced cross-sectional area adjacent the base of the container, said denture receiving portion defining an essentially U-shaped cavity adapted to hold dentures;

support means in said denture receiving portion to support dentures placed in said device;

a container lid adapted for engagement with said container, said lid having a manually rotatable brush extending therethrough such that when said lid is fitted on said container said brush extends into said container whereupon rotation of said brush acts to clean said dentures, said U-shaped cavity of said denture receiving portion preventing said dentures from rotating with said brush.

2. A denture brushing device as claimed in claim 1 in which said denture receiving portion is formed with an inset bracing wall extending across said container to define said essentially U-shaped cavity to hold said dentures, said bracing wall to prevent rotation of said dentures within said cavity.

3. A denture brushing device as claimed in claim 1 in which said denture receiving portion comprises a replaceable insert having a base and a step extending upwardly from said base and adapted for insertion into said container; said step defining said essentially U-shaped cavity within said container to hold dentures.

4. A denture brushing device as claimed in claim. 3 in which said base of said insert is formed with support means comprising upwardly extending bristles.

5. A denture brushing device as claimed in claim 1 in which said support means comprises a plurality of upstanding bristles.

6. A denture brushing device as claimed in claim 1 including a suction cup attachment comprising a receptacle portion adapted to receive and hold said container; and a suction cup attached to said receptacle portion to allow said suction cup attachment to be removably attached to a surface.

* * * * *